United States Patent [19]

Millar

[11] 4,391,203

[45] Jul. 5, 1983

[54] SECURITY APPARATUS

[76] Inventor: Frederick W. Millar, Victoria, Australia

[21] Appl. No.: 243,910

[22] PCT Filed: Jun. 25, 1980

[86] PCT No.: PCT/AU80/00025

§ 371 Date: Feb. 26, 1981

§ 102(e) Date: Feb. 26, 1981

[87] PCT Pub. No.: WO81/00043

PCT Pub. Date: Jan. 22, 1981

[30] Foreign Application Priority Data

Jun. 2, 1979 [AU] Australia ..... PD9421

[51] Int. Cl.[3] ..... E05G 1/12; G08B 13/20

[52] U.S. Cl. ..... 109/25; 109/41; 109/29

[58] Field of Search ..... 109/25, 27, 29, 31, 109/36–37, 39–40, 41, 1 R, 20, 62; 137/505; 232/58; 220/408

[56] References Cited

U.S. PATENT DOCUMENTS

| | | | |
|---|---|---|---|
| 493,544 | 3/1893 | Clawson | 232/58 |
| 551,966 | 12/1895 | Holly | 137/505 |
| 623,689 | 4/1899 | Smith | 109/31 |
| 1,228,804 | 6/1917 | Miller | 220/408 |
| 1,606,516 | 11/1926 | Daly | 109/25 |
| 1,936,385 | 11/1933 | Dilatush | 109/25 |
| 3,829,851 | 8/1974 | Evan et al. | 340/258 R |

FOREIGN PATENT DOCUMENTS

| | | |
|---|---|---|
| 645154 | 10/1928 | France . |
| 1368314 | 11/1964 | France . |
| 198675 | 5/1923 | United Kingdom . |
| 735766 | 8/1955 | United Kingdom . |
| 920664 | 3/1963 | United Kingdom . |
| 945498 | 1/1964 | United Kingdom . |

*Primary Examiner*—Robert Peshock
*Assistant Examiner*—J. Weiss
*Attorney, Agent, or Firm*—Cushman, Darby & Cushman

[57] ABSTRACT

Security apparatus which is operable to protect valuables by triggering an alarm and/or by defacing or rendering the valuables unusable on a change of pressure in a pressure sealable chamber. In a first embodiment suitable for use as a cash box (10), the valuables are received in a hollow receptacle (21) surrounded by a vacuum chamber (22) and a dye bomb (39) within the receptacle (21) is exploded on loss of vacuum within the vacuum chamber (22). In a second embodiment suitable for protecting the contents of mail bags, a hollow plug structure (63) is fitted to the nekc of a mail bag. The plug structure (63) has an opening (65) communicating with the interior of the mail bag so that the interior of the plug structure (63) and the interior of the mail bag can be evacuated to form a vacuum chamber. The plug structure (63) carries a dye container (69) from which dye is sprayed into the mail bag on loss of vacuum within the chamber. A third embodiment protects a painting or similar artwork by formation of a vacuum chamber (86) between the painting and a wall (83) from which it is mounted. The vacuum chamber (86) contains a battery operated alarm (93) to be triggered on loss of vacuum within the chamber (86).

12 Claims, 7 Drawing Figures

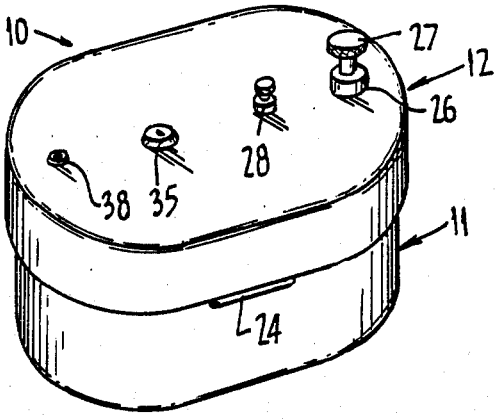
FIG. 1.
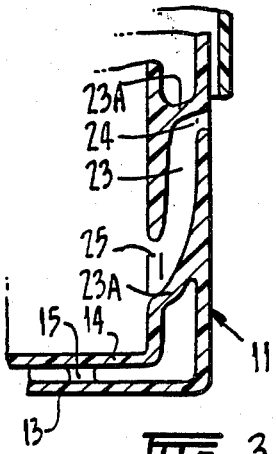
FIG. 3.
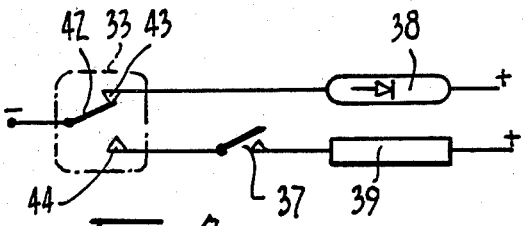
FIG. 4.
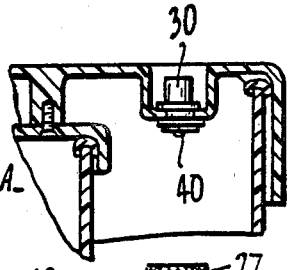
FIG. 2A.
FIG. 2.
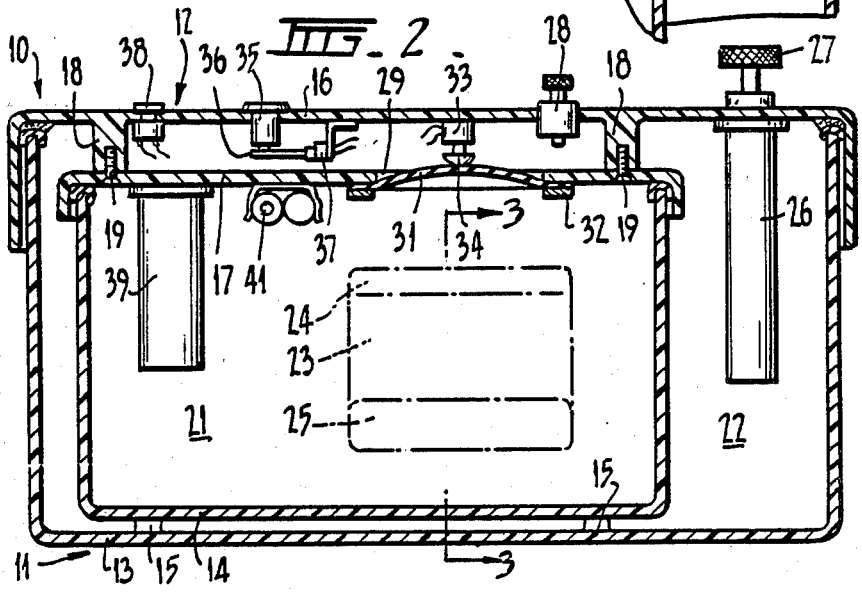

SECURITY APPARATUS

TECHNICAL FIELD

This invention relates to security apparatus for protecting valuables against theft. It has particular, but not exclusive application to the protection of valuables stored in security enclosures, whether those enclosures be portable enclosures such as cash boxes and mail bags or fixed installations as in the case of bank vaults and safes.

BACKGROUND ART

Conventional security equipment tends to be expensive and is generally not suited for protecting valuables carried in transportable containers. The contents of small cash boxes such as those commonly carried in taxis, and the often very valuable contents of mail bags are particularly vulnerable to theft, frequently under threat of arms or violence. The present invention enables protection to be provided in these circumstances quite cheaply but most effectively. The invention does, however, have application to large scale security installations because it enables the provision of security apparatus which is virtually tamperproof and cannot be rendered ineffective as in the case of even quite sophisticated conventional electrical systems.

DISCLOSURE OF INVENTION

The present invention provides security apparatus which is operable to protect a valuable by triggering an alarm and/or by defacing or rendering the valuable unusable on a change of pressure in a pressure sealable chamber.

More particularly, the invention provides security apparatus comprising

- valuable property holding means to hold valuable property;
- chamber forming means to form a pressure sealable chamber the sealing of which will be broken by unauthorized access and/or removal of the valuable property; and
- means operable by change of pressure in said chamber to produce an alarm signal and/or to deface the property or render it useless.

The chamber forming means may be a structure defining said chamber by itself or capable of forming the chamber in association with the property holding means and/or the property to be protected.

Preferably, the chamber forming means is provided with means through which to evacuate the chamber to sub-atmospheric pressure. Such means may comprise a vacuum pump or a suction fitting for connection to a vacuum pump and a one-way valve to seal against loss of vacuum pressure in the chamber.

The means to produce an alarm signal and/or to deface the property or render it useless may comprise a pressurized aerosol source or pressure-pack of a dye, or an explosive pack of such a dye for defacing the valuable and operable by movement of a flexible diaphragm responsive to change of pressure within the chamber.

BRIEF DESCRIPTION OF DRAWINGS

In order that the invention may be more fully explained two particular embodiments will be described with reference to the accompanying drawings in which:

FIG. 1 is a perspective view of a cash box constructed in accordance with the invention;

FIG. 2 is a vertical cross-section through the case box illustrated in FIG. 1;

FIG. 2A shows a modification of the construction illustrated by FIG. 2;

FIG. 3 is a cross-section on the line 3—3 in FIG. 2;

FIG. 4 illustrates a circuit for certain electrical components incorporated in the cash box illustrated in FIGS. 1 to 3;

FIGS. 1 to 4 illustrate a cash box 10 formed as a double walled container comprised of a main body structure 11 and a lid structure 12 which may conveniently be made of fibreglass reinforced plastic.

Figure 5:
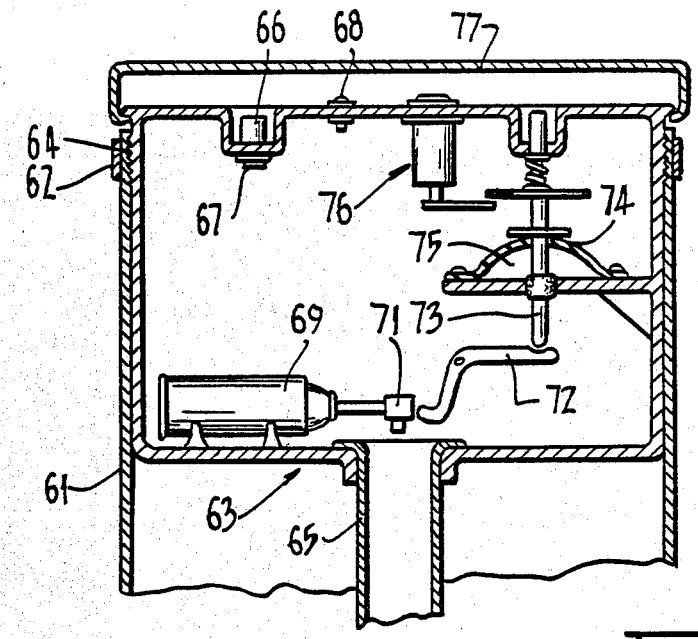
FIG. 5 is a cross-section through an alternative form of security apparatus designed particularly for protecting the contents of a mail bag.

Body structure 11 comprises an outer open topped rectangular box-like shell 13 and an inner shell 14 which is of similar shape but of smaller size so as to fit within the outer shell. The two shells 13, 14 are rigidly connected together by connectors 15 which are bonded to the two shells to hold them in spaced apart relationship in the composite body structure.

Lid structure 12 is also of composite structure. It comprises an outer lid shell 16 to form a closure for the outer shell 13 of body structure 11 and an inner lid shell 17 to form a closure for the inner shell 14 of the body structure. A series of posts 18 are formed integrally with the outer lid shell 16 and the inner lid shell 17 is fastened to these posts by screws 19 so that the outer and inner lid shells are spaced apart in the composite lid structure.

The outer lid shell 16 of lid structure 12 is fitted with U-section sealing strips to engage the rims of the shells 13, 14 of body structure 11. When the lid structure 12 is fitted to body structure 11, the lid shell 16 and the body shell 13 form a sealed outer enclosure and the lid shell 17 of the inner body shell 14 form a hollow-receptacle 21 which is spaced within the outer enclosure so as to be entirely enveloped by a sealed chamber 22 defined between it and the outer enclosure. As will be explained below, chamber 22 is evacuated to sub-atmospheric pressure when the cash box is in use.

In use of the cash box coins and bank notes are deposited into the inner receptacle 21 via a money chute 23 which extends downwardly between the inner and outer shells of body structure 11 from a slot 24 in the outer shell to a slot 25 in the inner shell. The perimeter wall 23A of chute 23 is formed integrally with the inner and outer shells so as to seal the chute from the vacuum chamber 22.

Outer lid shell 16 carries a vacuum pump 26 which is manually operable by reciprocation of a plunger 27 to evacuate chamber 22 when the lid structure is fitted to the container structure. Chamber 22 can thus be evacuated to a substantially sub-atmospheric pressure such that the lid structure is held firmly in place by suction without the aid of mechanical locks or clamps, although external latches or clamps can be provided in order to ensure proper sealing before evacuation of chamber 22.

FIG. 2A illustrates a modification in which the vacuum pump is replaced by a recessed suction fitting 30 which can be connected by a hose or tube to an external vacuum pump when chamber 22 is to be evacuated. A one-way valve 40 is provided to prevent loss of vacuum in the chamber when the vacuum pump is subsequently disconnected.

Outer lid shell 16 also carries a manually operable vacuum relief valve 28 which can be closed to enable evacuation of chamber 22 and opened to release the vacuum when the cash box is to be opened, as will be explained below.

Inner lid shell 17 is provided with an opening 29 sealed by a flexible diaphragm 31 fastened to the lid shell by a clamping or sealing ring 32. The position adopted by diaphragm 31 depends on the pressure differential between chamber 22 and the interior of receptacle 21, which is always subject to atmospheric pressure. When chamber 22 is evacuated the exterior face of diaphragm 31 is subject to sub-atmospheric pressure and the diaphragm expands outwardly. If the vacuum within the chamber 22 is broken for any reason the diaphragm moves inwardly due to the loss of vacuum pressure. Thus the diaphragm moves in and out according to the vacuum pressure within compartment 22.

Outer lid shell 16 carries a diaphragm operated switch 33 having an actuator plunger 34 which engages diaphragm 31 so that the switch is actuated by movement of the diaphragm according to the vacuum pressure within the chamber 22.

Outer lid shell 16 also carries a key operated lock 35. A key may be inserted into this lock and turned to rotate a lever 36 which actuates an electrical switch 37. The diaphragm operated switch 33 and the lock operated switch 37 are connected into an electrical circuit together with an LED display tube 38 mounted on outer lid shell 16 and an explodable dye bomb 39 and a two-cell battery 41 which is mounted on the underside of the inner lid shell 11. Dye bomb 39 comprises a cylindrical casing charged with a liquid dye and an explosive detonator wired into the electrical circuit.

The electrical circuit is illustrated in FIG. 4. As indicated in that figure the diaphragm actuated switch 33 has a movable contact 42 which is connected to the negative terminal of the battery and which moves between two fixed contacts 43, 44. The LED tube is connected between the fixed contact 43 and the positive terminal of battery 41. Lock actuated switch 37 connects the detonator of dye bomb 39 in series with the fixed contact 44 of switch 33 and the positive terminal of the battery.

In order to prepare the cash box ready for use, the lid structure 12 is applied to the body structure 11 with the switch open. The movable contact 42 of switch 33 normally engages the fixed contact 44 but vacuum pump 26 is now operated to evacuate chamber 22 to such an extent that contact 42 is moved to engage contact 43 so causing illumination of LED tube 38. This indicates that lock actuated switch 37 can be actuated to put the dye bomb detonator in circuit.

The cash box is then in such a condition that any loss of vacuum within the chamber 22 due to attempts to obtain access to the contents of receptacle 21 without proper actuation of the key lock 35 will cause contact 42 to close the circuit with the detonator of dye bomb 39. The detonator will thus be exploded and any contents in receptacle 21 will be impregnated with dye and rendered worthless.

In order to open the cash box and retrieve the contents of receptacle 21, lock 35 must be properly actuated by a key so as to rotate dye bomb 39 from the remainder of the electrical circuit. The vacuum within chamber 22 is then relieved by actuation of release valve 28 so causing contact 42 to move away from contact 43 to extinguish the LED tube. The lid structure 12 can then be removed to allow access to the contents of receptacle 21.

A further embodiment of the invention designed specifically to protect the contents of mail bags is illustrated in FIG. 5. This apparatus comprises a tubular adapter 61 to which the neck of a mail bag can be clamped by a quick release clamp 62. A hollow plug structure 63 is fitted within adapter 61 by a screw coupling 64. The interior of plug structure 63 communicates with the interior of the mail bag via a flexible tube 65 which is preferably long enough to extend to the bottom of the bag. Thus the interior of plug structure 63 and the interior of the mail bag form a chamber which can be evacuated to sub-atmospheric pressure by connecting a vacuum pump to a hose fitting 66 formed on the outer face of plug structure 63 and fitted with a non-return valve 67. The outer wall of plug structure 63 is also fitted with a visual vacuum gauge 68.

A pressure-pack 69 containing a dye compound is mounted within plug structure 63 with its spray head 71 positioned such that when the pressure-pack is operated it sprays dye compound down flexible tube 65 and into the interior of the mail bag. Pressure-pack 69 is actuated via a bell crank 72 by movement of a spring loaded actuator rod 73 caused by movement of a flexible wall 74 of a chamber 75 within the interior of plug structure 63. The interior of chamber 75 is charged to atmospheric pressure so that the flexible chamber wall 74 moves on loss of vacuum within the mail bag and plug structure 63.

Actuator rod 73 can be locked against movement by a key operated locking mechanism 76 to permit removal of the apparatus from the mail bag for legitimate access to the contents of the mail bag.

Plug structure 63 may be provided with a pressfit seal cap 77.

Figure 6:
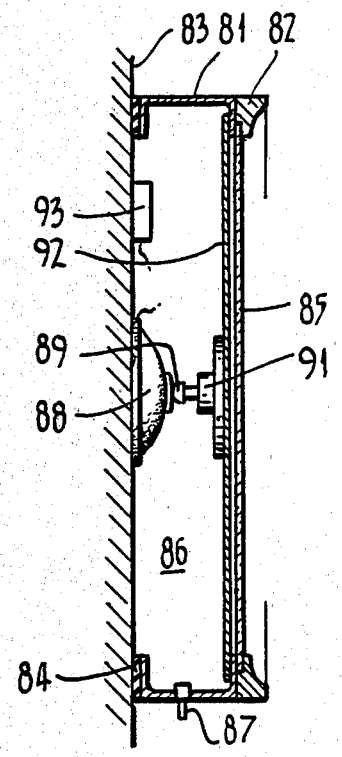
FIG. 6 is a cross-section through a further embodiment of the invention designed for the protection of valuable paintings or like works of art.

FIG. 6 illustrates a further embodiment of the invention designed for the protection of valuable paintings or like works of art. In this embodiment a rectangular frame 81 provided with a conventional picture frame front 82 is fastened to a wall 83. The interface between the frame and the wall is sealed by an adhesive perimeter seal 84 and the front of the frame is closed by a panel 85 which may be in the form of a mounting plate for the painting or a glass front panel behind which the painting is mounted. A chamber 86 is defined between the wall 83, the frame 81 and the front panel 85 and this chamber can be evacuated to sub-atmospheric pressure via a vacuum fitting 87 on frame 81.

within chamber 86 there is a diaphragm unit 88 which encloses a charge of air at atmospheric pressure. Diaphragm unit 88, which may conveniently be fastened directly to wall 83, engages the actuator plunger 89 of an electrical switch 91 which is carried on a bracket 92 fastened to frame 81. Switch 91 is electrically connected to a battery operated alarm 93 also mounted within the chamber 86. Conveniently, the battery operated alarm may be mounted directly on wall 83.

When chamber 86 is evacuated to sub-atmospheric pressure the diaphragm unit 88 holds switch 91 open and the alarm is inoperative. However, as soon as any attempt is made to move the painting, either by interfering with front panel 85 or with the connection of frame 81 to the wall, the vacuum within the chamber 86 is destroyed and diaphragm unit 88 moves to close switch 91 to thereby activate the alarm.

In the system illustrated in FIG. 6, all of the components required to activate the alarm are enclosed within the vacuum chamber and it is not possible to obtain access to them without activating the alarm. The alarm may be powered by rechargeable nickel cadmium batteries in which case an electrical lead could be run through the adhesive seal to the exterior of the frame to facilitate recharging of the batteries.

INDUSTRIAL APPLICABILITY

From the above described specific embodiments, it will be appreciated that the invention will have wide application and that apparatus constructed in accordance with the invention may vary considerably according to the particular application. In the case of the cash box illustrated in FIGS. 1 to 4, the valuable property to be protected is held within a receptacle which is enveloped by the vacuum chamber. In the case of the mail bag security system illustrated in FIG. 5, the valuables to be protected are held within an enclosure forming part of the vacuum chamber itself and in the case of the art protection system illustrated in FIG. 6, the valuable may itself form part of the wall of the vacuum chamber.

The invention may also be applied to large scale installations such as bank safes or vaults. In this case the whole of the interior of the safe or vault could be evacuated to sub-atmospheric pressure and an alarm triggering device such as a diaphragm operated switch could be located within the safe or vault such that access to it is impossible without destroying the vacuum so as to cause activation of the alarm.

It is accordingly to be understood that many modifications and variations will fall within the scope of the appended claims.

I claim:

1. A transportable security container comprising: a hollow receptacle for receiving valuables; an enclosure surrounding the hollow receptacle such as to form between the enclosure and the receptacle a chamber enveloping the receptacle; a chute extending from an opening in the enclosure and through the chamber and into the interior of the receptacle through which to deposit valuables into the receptacle; a flexible diaphragm incorporated in the wall of the receptacle and movable in response to changes of pressure within the chamber; a pack of dye disposed within the receptacle; and means to cause discharge of the dye in response to movement of the diaphragm on change of pressure within the chamber.

2. A security container as claimed in claim 1, wherein the enclosure is provided with evacuation means through which to evacuate the chamber to sub-atmospheric pressure.

3. A security container as claimed in claim 2, wherein the evacuation means comprises a suction fitting for connection to a vacuum pump and a one-way valve to seal against loss of vacuum pressure in the chamber.

4. A security container as claimed in claim 1, wherein the means to cause discharge of the dye comprises an electrically operable explosive detonator connected in an electrical circuit with an electrical switch actuable by movement of the diaphragm.

5. A security container as claimed in claim 2, wherein the receptacle and the enclosure are formed by a body structure and a lid structure, the body structure comprising an inner open-topped receptacle shell and an outer enclosure shell surrounding and spaced from the inner shell and the lid structure comprising an inner lid shell to form a closure for the inner receptacle shell of the body structure and outer lid shell to form a closure for the outer enclosure shell of the body structure whereby, when the lid structure is fitted to the body structure, said enclosure is formed by the outer enclosure shell of the body structure and the outer lid shell of the lid structure and said receptacle is formed by the inner receptacle shell of the body structure and the inner lid shell of the lid structure.

6. A portable security container comprising: an open-topped receptacle to receive valuable property and a plug structure to plug the open top of the receptacle, wherein said plug structure is hollow and has an opening for communication of the interior of the plug structure with the interior of the receptacle to form a pressure sealed chamber and means disposed within the hollow plug structure and operable by change of pressure in said chamber to produce an indication that the container has been opened.

7. Security apparatus as claimed in claim 5, wherein said receptacle is an open topped bag.

8. Security apparatus as claimed in claim 5, wherein the plug structure is provided with evacuation means through which to evacuate the chamber to sub-atmospheric pressure.

9. Security apparatus as claimed in claim 5, wherein said opening is fitted with a tube to extend to the interior of the receptacle at a location remote from the plug structure.

10. Security apparatus as claimed in claim 5, wherein the means operable by change of pressure in said chamber to produce an indication that the container has been opened comprises a pack of dye disposed within the hollow plug structure and dye discharge means to cause discharge of dye through said opening into the interior of the receptacle on change of pressure within the chamber.

11. Security apparatus as claimed in claim 10, wherein the means to cause discharge of the dye comprises a diaphragm actuated mechanism disposed within the plug structure.

12. Security apparatus as claimed in claim 10, wherein there is a locking mechanism operable to render the dye discharge means ineffective.

* * * * *